US007303155B2

(12) United States Patent
Kesti et al.

(10) Patent No.: US 7,303,155 B2
(45) Date of Patent: Dec. 4, 2007

(54) LINE STRIPER GUN AND DELAY SELECTOR

(75) Inventors: Timothy J. Kesti, Big Lake, MN (US); Christopher A. Lins, Milaca, MN (US); Jon M. Knutson, Maple Grove, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 614 days.

(21) Appl. No.: 10/498,176

(22) PCT Filed: Jan. 14, 2003

(86) PCT No.: PCT/US03/01020

§ 371 (c)(1),
(2), (4) Date: Jun. 9, 2004

(87) PCT Pub. No.: WO03/059523

PCT Pub. Date: Jul. 24, 2003

(65) Prior Publication Data

US 2005/0001068 A1 Jan. 6, 2005

Related U.S. Application Data

(60) Provisional application No. 60/349,043, filed on Jan. 15, 2002.

(51) Int. Cl.
*B05B 1/30* (2006.01)

(52) U.S. Cl. ..... 239/578; 239/150; 239/305; 239/337; 239/532; 222/174; 222/402.14; 251/294

(58) Field of Classification Search ..... 239/146, 239/150, 303, 304, 305, 337, 532, 578; 251/294; 222/174, 402.14
See application file for complete search history.

(56) References Cited

U.S. PATENT DOCUMENTS

| | | | | |
|---|---|---|---|---|
| 1,436,145 | A | | 11/1922 | Birkenmaier |
| 2,893,606 | A | * | 7/1959 | Hawkins ..... 222/174 |
| 2,964,245 | A | | 12/1960 | Anderson et al. |
| 3,366,337 | A | | 1/1968 | Brooks et al. |
| 3,782,507 | A | | 1/1974 | Shreve |
| 3,856,209 | A | | 12/1974 | Hickson |
| 3,915,388 | A | | 10/1975 | Nathan |
| 4,057,127 | A | | 11/1977 | Woodring |
| 4,092,000 | A | | 5/1978 | Offutt, III |
| 4,267,746 | A | | 5/1981 | Pruett |
| 4,660,745 | A | * | 4/1987 | Hess, Jr. ..... 222/174 |
| 4,667,880 | A | | 5/1987 | Paulsen et al. |
| 4,773,510 | A | | 9/1988 | Sato |
| 5,284,301 | A | | 2/1994 | Kieffer |
| 5,518,148 | A | * | 5/1996 | Smrt ..... 222/174 |
| 5,540,304 | A | | 7/1996 | Hawkins et al. |
| 6,029,862 | A | * | 2/2000 | Jones ..... 222/402.14 |
| 6,062,443 | A | | 5/2000 | Smrt |

* cited by examiner

*Primary Examiner*—Steven J. Ganey
(74) *Attorney, Agent, or Firm*—Douglas B. Farrow

(57) ABSTRACT

A hand trigger (16) is pivotally mounted on the handlebar (12) of the striper (14). A pair of selectors (26) are pivotally mounted at the trigger pivot points. The selectors (26) are made from a spring or spring-like steel, which allows the selectors (26) to springingly deform for gun selection and adjustment yet return to their original position and shape. This allows delayed gun activation, disabling of one or both guns from the trigger (16) and functioning as a one-handed gun selector.

2 Claims, 2 Drawing Sheets

LINE STRIPER GUN AND DELAY SELECTOR

TECHNICAL FIELD

This application claims the benefit of U.S. application Ser. No. 60/349,043, filed Jan. 15, 2002.

BACKGROUND ART

Walk-behind (and self-propelled) line stripers have become a well-accepted method of applying striping to parking lots and roads. Often, it is desired to apply two parallel lines either where both are solid or where one is a dashed line. While dual gun stripers are well-known, the controls for operating both guns have proven less than completely user friendly.

DISCLOSURE OF TH INVENTION

It is therefore an object of this invention to provide a hand control for dual-gunned stripers which may be easily and quickly adjusted between configurations without the use of tools.

A hand trigger is pivotally mounted on the handlebar of the striper. A pair of selectors are pivotally mounted at the trigger pivot points. The selectors are made from a blue tempered 1095 carbon steel or a Blu Clox spring steel which allows the selectors to springingly deform for gun selection and adjustment yet return to their original position and shape. This allows delayed gun activation, disabling of one or both guns from the trigger and functioning as a one-handed gun selector.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
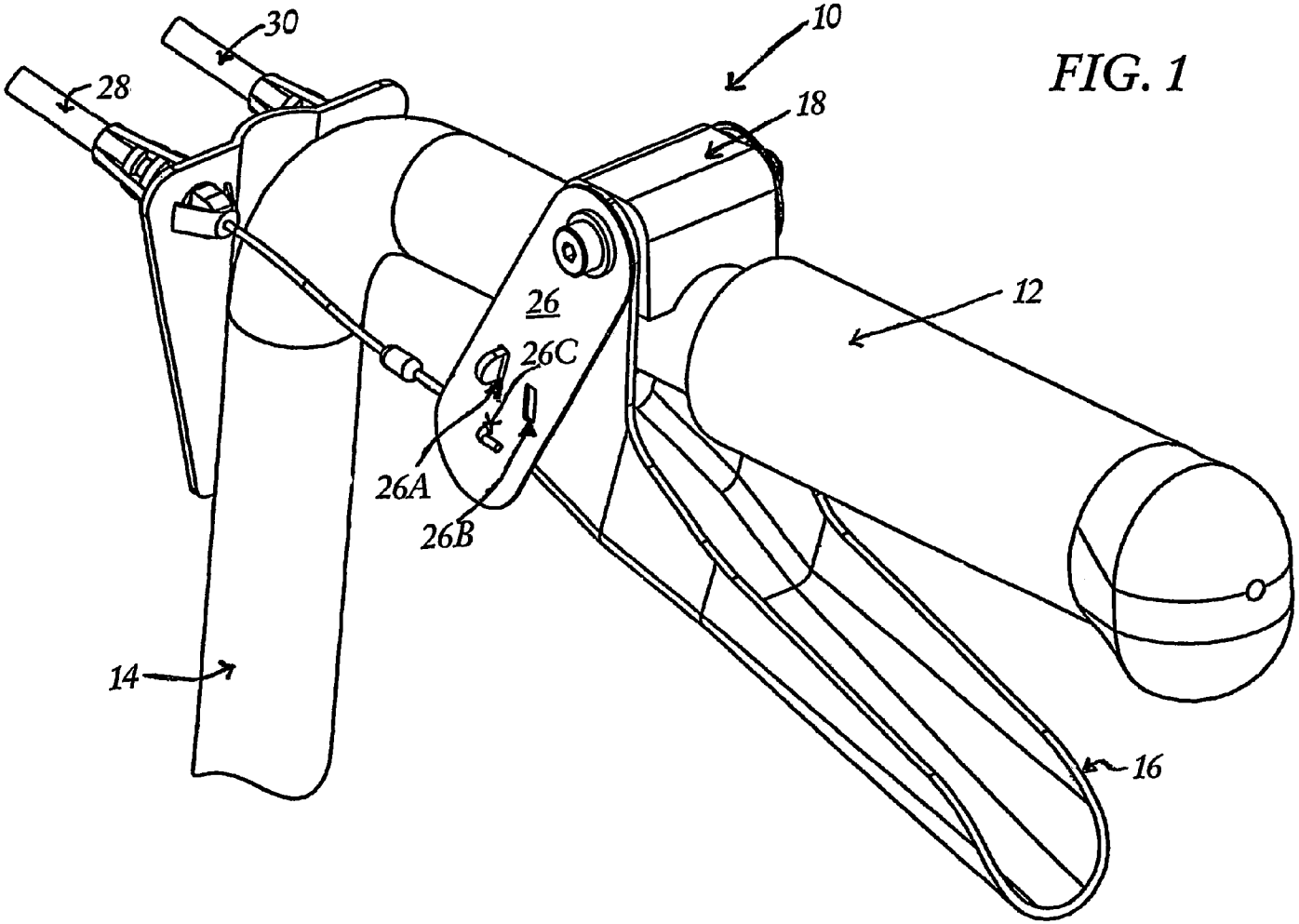
FIG. 1 is a perspective view of the instant invention.
Figure 2:
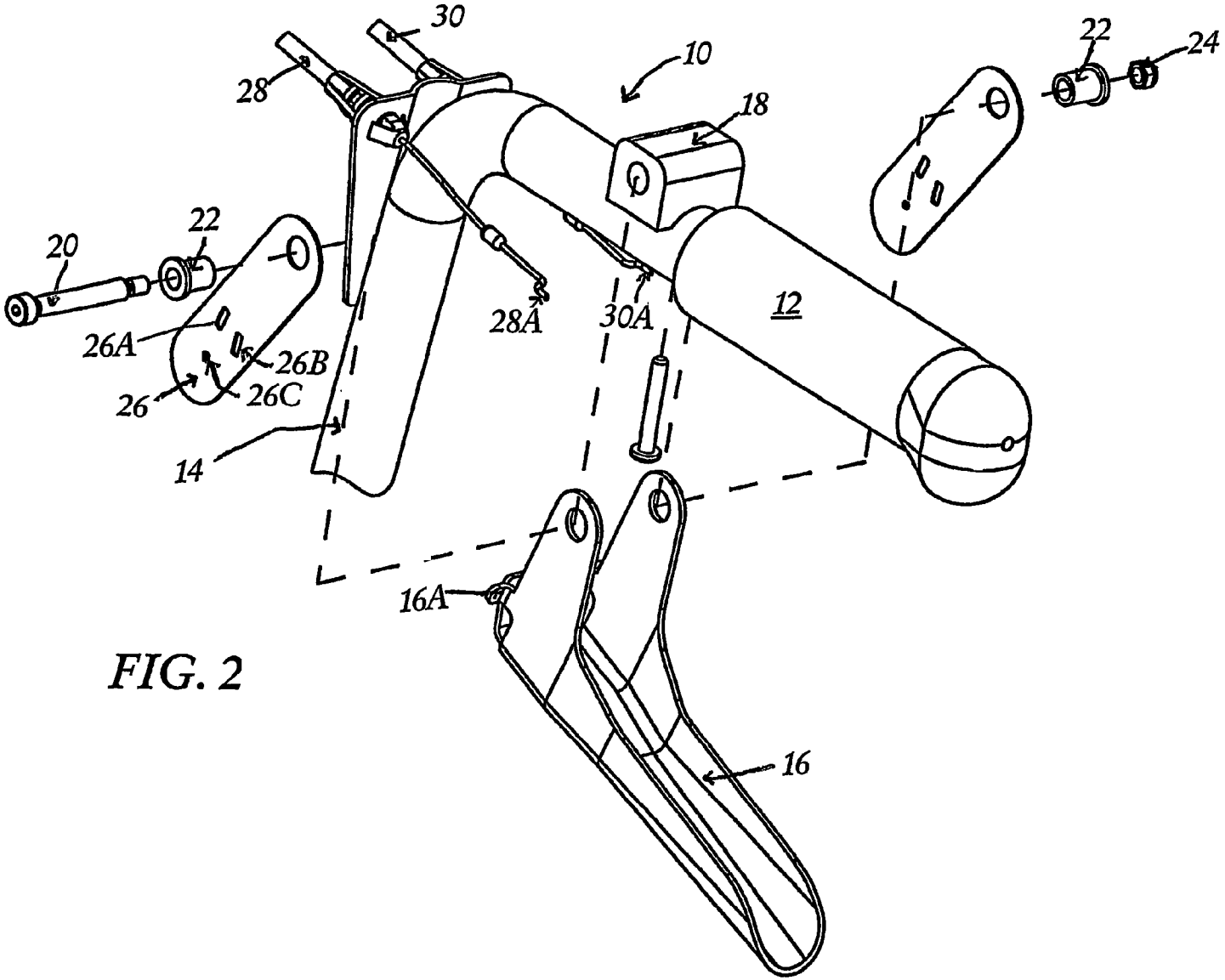
FIG. 2 is an exploded perspective view of the instant invention.

The instant invention, generally designated 10, is designed for mounting on the handlebar 12 of a line striper 14. Trigger 16 is pivotably mounted to trigger block 18 by means of screw 20, bushings 22 and nut 24. Also pivoting about screw 20 are selectors 26. The selectors 26 are made from a blue tempered 1095 carbon steel or a Blu Clox spring steel which allows the selectors to springingly deform for gun selection and adjustment yet return to their original position and shape. Trigger 16 has a trigger tab 16A extending from either side.

Selectors 26 have activation 26A and delayed activation 26B slots therein along with cable aperture 26C. First and second gun cables 28 and 30 respectively have ends 28A and 30A. The cables 28 and 30 are adjusted so that when trigger tabs 16A are located in activation slots 26A, the associated spray guns are activated relatively early in the trigger travel.

In operation, if one wishes to run two solid parallel lines, both trigger tabs 16A are located in activation slots 26A and the trigger is pulled when striping is desired. When only one line is desired, the selector 26 for the non-desired gun is moved so that trigger tab 16 is not engaged in either slot 26A or 26B. For spraying a solid-dashed line combination, The selector 26 for one gun is placed in activation slot 26A and the selector 26 for the other gun is placed in delayed activation slot 26B. The operator then needs merely to pull the trigger partway to spray the solid line while pulling the trigger 16 the rest of the way to provide the dashed line as desired.

It is contemplated that various changes and modifications may be made to the line striper gun and delay selector without departing from the spirit and scope of the invention as defined by the following claims.

The invention claimed is:

1. A gun selector mechanism for use on a line striper having a plurality of spray guns having activation cables, said gun selector comprising:

a pivot point a trigger pivotably mounted to said pivot point; and a plurality of gun selectors, each said selector being pivotably mounted to said pivot point, made of a spinglike material and comprising an aperture for receiving one of said cables and at least first and second slots for alternately engaging trigger, one of said slots being located so as to activate one of said spray guns early in the travel of said trigger and one of said other slots being located so as to activate one of said spray guns at substantially full travel of said trigger, each said selector being moveable by said trigger.

2. The gun selector mechanism of claim 1 wherein said trigger comprises at least one tab for engaging one of said selectors.

* * * * *